United States Patent [19]

Aten

[11] 4,288,966

[45] Sep. 15, 1981

[54] METHOD OF VACUUM TIMING CONTROL

[75] Inventor: Dwight W. Aten, Lebanon Township, Warren County, N.J.

[73] Assignee: Bell & Howell Company, Phillipsburg, N.J.

[21] Appl. No.: 54,509

[22] Filed: Jul. 3, 1979

[51] Int. Cl.[3] ..... B65B 43/00

[52] U.S. Cl. ..... 53/469; 53/266 A; 137/624.15; 137/624.2

[58] Field of Search ..... 53/468, 469, 84, 386, 53/266 A, 473, 481; 271/99; 137/624.2, 624.15

[56] References Cited

U.S. PATENT DOCUMENTS

| | | | |
|---|---|---|---|
| 2,325,455 | 7/1943 | Williams | 53/57 |
| 2,530,622 | 11/1950 | Maris | 137/624.15 |
| 2,857,964 | 10/1958 | Vore | 137/624.2 |
| 3,211,179 | 10/1965 | Lilly et al. | 137/624.15 X |
| 3,465,499 | 9/1969 | Nelson et al. | 53/386 |
| 3,844,551 | 10/1974 | Morrison | 271/99 |
| 3,913,463 | 10/1975 | Hollis | 53/386 X |
| 4,090,532 | 5/1978 | Story, Jr. | 137/624.2 X |
| 4,159,611 | 7/1979 | Russell | 53/386 X |

*Primary Examiner*—Horace M. Culver

*Attorney, Agent, or Firm*—Griffin, Branigan & Butler

[57] ABSTRACT

A method for selectively adjusting the duration of vacuum application to various stations of an insertion machine which ultimately inserts insertion material into an envelope.

10 Claims, 1 Drawing Figure

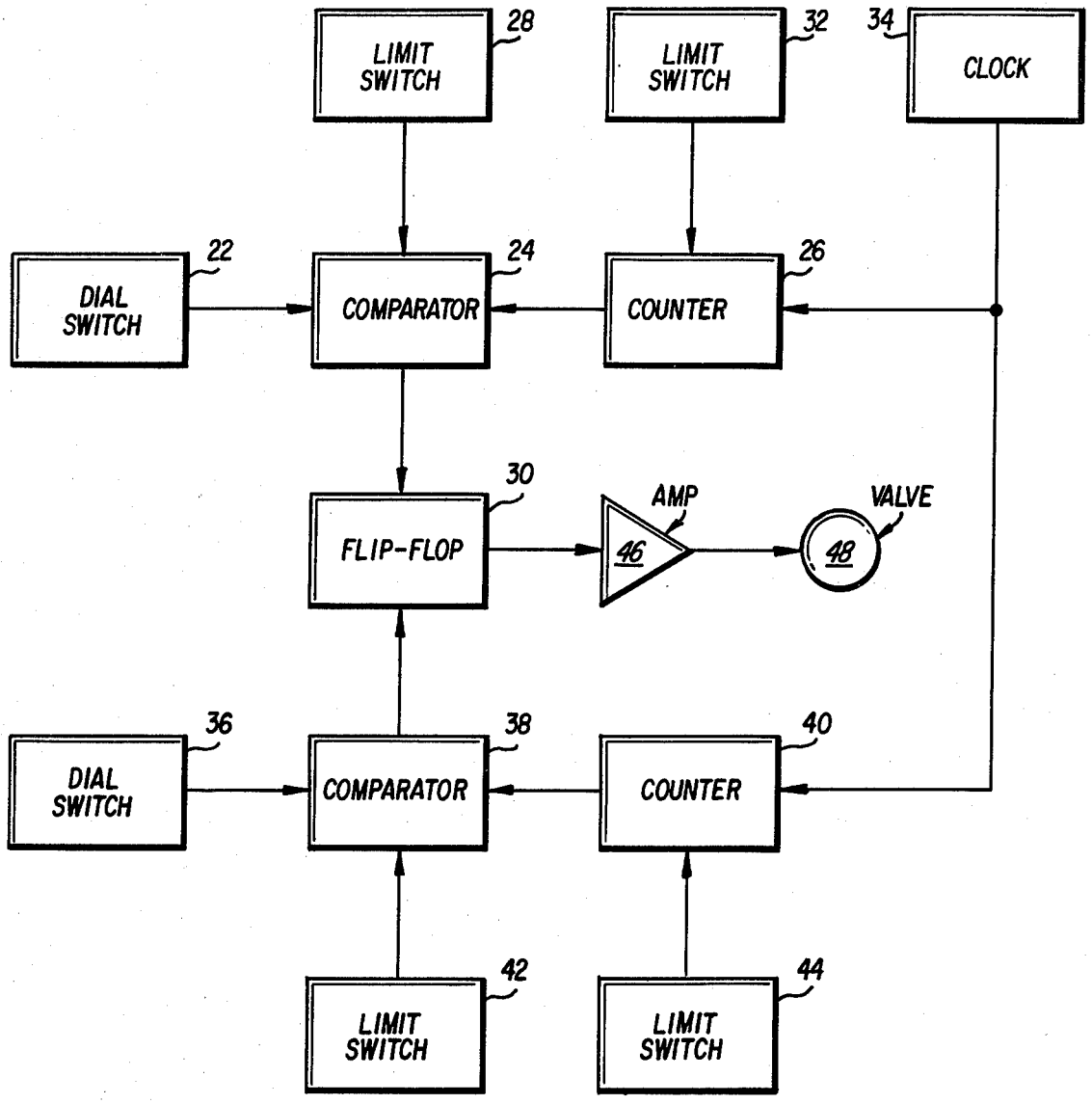
LIMIT SWITCH
28
LIMIT SWITCH
32
34
CLOCK
DIAL SWITCH
22
COMPARATOR
24
COUNTER
26
FLIP-FLOP
30
AMP
46
VALVE
48
DIAL SWITCH
36
COMPARATOR
38
COUNTER
40
LIMIT SWITCH
42
LIMIT SWITCH
44

METHOD OF VACUUM TIMING CONTROL

BACKGROUND

This invention pertains to a method of operating insertion machines, and in particular such machines wherein a vacuum is used at various machine stations to ultimately insert material into an envelope.

U.S. Pat. No. 2,325,455 to A. H. Williams relates to a multi-station inserter which performs numerous functions including extracting an envelope from an envelope supply station and transporting it to an inserting station where the envelope is opened. The machine also extracts pieces of insert material from one or more insertion supply stations and transports the aggregate material so extracted to the inserting station where it is inserted into the envelope.

The inserter described above provides a pneumatic mechanism for handling insertion material at each insertion supply station. In this regard, a pair of vacuum cups at each station applies suction to a lowermost piece of vertically stacked material at the station in order to deflect the lowermost piece for extraction by a gripper jaw. Each pair of vacuum cups for each insertion supply station is ultimately connected to a single control valve which simultaneously governs the transmission of the vacuum through the pairs of vacuum cups at each insertion supply station. In this respect, the control valve is operated once during each operating cycle of the inserter machine.

In an analogous manner, the inserter provides a similar pneumatic mechanism at the envelope supply station to engage successive envelopes. A second similar control valve is also timed to the machine operating cycle; and applies a vacuum to similar vacuum cups at the envelope supply station to engage a selected envelope.

In addition to the above-described inserter features, pneumatic means are also provided at the inserting station to draw front and back portions of each envelope away from one another in order to open the envelopes for reception of the aggregate insertion material. In this regard, vacuum cups are positioned above and below the plane of travel of the envelope at the inserting station; and, a third valve, timed with the operating cycle of the machine, operates the vacuum cups to open and close the envelope at the inserting station.

As indicated above, the vacuum supply is turned on or off at particular points, or increments, in the machine's operating cycle. These points are typically expressed in degrees of the machine's rotational cycle, each full cycle being 360°. The vacuum may be applied to each particular type station only during a range of degrees, or a "window," which corresponds to an appropriate stage in the inserting machine.

Since all the insertion supply stations are governed by a single valve, it follows that all of the insertion supply stations have the same vacuum timing. This is true regardless of the number or nature of such stations.

In operating in the above-described manner it often would be advantageous to vary the vacuum timings. For example, in the case of the insertion supply stations it would generally be economical to change the timing from station to station depending on the characteristics of the insertion material being handled at the respective stations. By way of illustration, heavier insertion material stacked at one station may require a longer vacuum duration than lighter material stacked at another station. Other material characteristics which may prompt variable vacuum timing include the degree of material warpage and flexibility. Also, the relative conditions of the operating environment, such as the degree of humidity, may have an impact on the desirable duration of vacuum timing.

In the past it has been possible to vary vacuum timings for all the insertion supply stations collectively by having a mechanic internally adjust the timing of the appropriate control valve. Of course, all the supply stations connected to the valve would be uniformly affected by this change in the valve timing. Moreover, it is unfortunate that a machine operator is not able to make the timing adjustments, but, instead is dependent upon the availability and skill of a mechanic to make the mechanical adjustments to the valve.

Accordingly, an object of this invention is to provide a timing control system to selectively vary the application of vacuum to individual stations of an insertion machine.

An advantage of this invention is the capability for an operator to externally select the variable vacuum application for individual stations without the need for internal structural adjustment by a mechanic.

A further advantage of this invention is the conservative and economical use of a vacuum in an inserter depending on the variable operating considerations for different stations of the machine.

SUMMARY

This invention pertains to a method of selectively timing the application of a vacuum to various stations of an insertion machine. The method permits an operator to externally and selectively adjust the time duration during which a vacuum is applied to the various stations. In this respect, the operator may select a vacuum start time and a vacuum end time for each station, the start and end times corresponding to different increments, or degrees, of the inserter machine cycle.

The method allows the operator to selectively control the initiation and duration of vacuum application needed to ultimately extract differing types of insertion material respectively contained in a plurality of insertion supply stations. Likewise, the operator can select the initiation and duration of vacuum application needed to extract an envelope from a stack of envelopes contained at an envelope supply station. In addition, the operator can selectively vary the initiation and duration of suction application needed for opening a flap of an envelope and in separating a front panel of the envelope from a back panel of the envelope so as to accommodate the material inserted therein.

BRIEF DESCRIPTION OF THE DRAWING

The foregoing and other objections, features, and advantages of the invention will be apparent from the following more particular description of preferred embodiments as illustrated in the accompanying drawing. The drawing is not necessarily to scale, emphasis instead being placed upon illustrating the principles of the invention.

FIG. 1 is a schematic view of circuitry designed to implement one embodiment of the invention.

DETAILED DESCRIPTION OF THE DRAWING

As discussed above, insertion machines, such as that disclosed in U.S. Pat. No. 2,325,455 to Williams, comprise numerous stations which may employ a vacuum to extract both envelopes and insertion material, and to open the envelopes prior to projecting the insertion material therein. Each of these stations employs separate suction means for the extraction and envelope-opening processes. From the outset it should be understood that these suction means may take various forms. For example, the suction means may be suction cups as illustrated in the Williams '455 patent or suction grooves as illustrated in U.S. Pat. No. 3,844,551 to Morrison—both patents being incorporated herein by reference.

FIG. 1 schematically illustrates circuitry suitable for implementing vacuum control at an individual station of the inserter machine. Thus, it is to be understood that the circuitry of FIG. 1 can pertain to any and all of the individual stations, whether it be, for example, one of the insertion supply stations, the envelope supply station, or the inserting station.

FIG. 1 comprises a selectable vacuum-timing start switch, such as thumbwheel switch 22, which is of a type that may be selectively dialed through a range of numbered settings, for example to any number between 1 and 9. The switch 22 is electrically connected to a first data input terminal of a comparator 24. A second data input terminal of the comparator 24 is connected to an output terminal of a binary counter 26; and an enable input of the comparator 24 is connected to a first limit switch 28. The output terminal of the comparator 24 is connected to a multi-vibrator means, such as flip-flop 30. In addition to its output terminal, the binary counter 26 has a reset terminal connected to a second limit switch 32 and a counter-input terminal connected to a clocking means, such as pulser 34.

FIG. 1 also includes a selectable vacuum-timing end switch, such as thumbwheel switch 36, also selectively adjustable through a range of numbered settings. Switch 36 is ultimately electrically connected to a reset terminal of flip-flop 30 through circuitry whose components and connections are virtually the mirror image of the circuitry discussed in the previous paragraph. In this regard, the circuitry comprises a second comparator 38 corresponding to the first comparator 24; a second binary counter 40 corresponding to the first binary counter 26; a third limit switch 42 corresponding to the first limit switch 28; and, a fourth limit switch 44 corresponding to the second limit switch 32.

The flip-flop 30 has an output terminal connected to the input terminal of a suitable power amplifier 46. The output terminal of amplifier 46 is in turn electrically connected to the solenoid valve 48 which is in fluid communication both with the suction means at the inserter machine station and with a vacuum supply.

As mentioned before, some inserter machines have a machine cycle which may be expressed in terms of degrees. One embodiment of the invention has such a cycle consisting of 360°. In this embodiment the various stations of the inserter machine generally operate only during a portion; or "window," of the machine cycle. For example, the insertion supply stations may be operated in a time window ranging from 20° in the machine cycle to 100°. In this manner, other functional units of the inserter machine can operate in a compatible manner with the insertion supply stations if the insertion supply stations perform their tasks during this window time. The inserting station, on the other hand, which is downstream in the processing sequence from the insertion supply stations, generally operates during later portions of the machine cycle. For example, the inserting station may be effectively operative from 250° to 330° of the machine cycle.

In operation, the operator selects a start time using the thumbwheel switch 22. That is, the operator may selectively dial any number in a range of numbers provided on the switch 22. In one embodiment, each numbered dial setting on the switch 22 corresponds to a point in the machine cycle which is in the pertinent window for the respective station. If an exemplary switch 22 were to have 9 settings, a setting of 1 would bring the vacuum on at the beginning of the widow, a setting of 2 would bring the vacuum on 10° later, and so on.

Likewise, the operator selects an end time using the thumbwheel switch 36. As in the embodiment discussed in the preceding paragraph, each numbered dial setting on the switch 36 corresponds to a point in the machine cycle which is in the pertinent window for the respective station. Again using the example of a switch having 9 settings, a setting of 9 would shut the vacuum off at the end of the window, a setting of 8 would shut the vacuum off 10° earlier, and so on. In no event, however, would the timings for the two switches 22 and 36 overlap. That is, the switch 22 always operates before switch 36.

At every 10 degrees or so increment of the machine cycle the pulser 34 generates an electric pulse and applies the pulse to the binary counters 26 and 40. The limit switches 32 and 44 monitor the machine cycle and signal when the machine cycle is approaching the window of interest to the particular station involved. The limit switches 32 and 44 reset the respective binary counters 26 and 40 to zero just prior to the earliest point in the machine cycle which corresponds to the beginning of the pertinent window. For example, if an insertion supply station has a window from 20° to 100° in the machine cycle, the limit switches 32 and 44 reset the binary counters 26 and 40 to zero just prior to 20° in the machine cycle.

After the binary counters 26 and 40 have been reset in this manner, the counters 26 and 40 store the number of pulses applied to them by the pulser 34. The binary counters 26 and 40 generate an output signal proportional to the number of pulses so detected during the pertinent timing window. These output pulses are fed to comparators 24 and 38, respectively, which are enabled only during the pertinent timing window as governed by limit switches 28 and 42 respectively. In this regard, the limit switches 28 and 42 function in much the same manner as limit switches 32 and 44, respectively.

When enabled during the pertinent timing window as discussed above, the comparator 24 compares the signal received from the binary counter 26 with the signal received from the thumbwheel switch 22. When the signal from thumbwheel switch 22, which is proportional to the desired start time of vacuum application with reference to the pertinent time window, is equal to the signal received from the binary counter 26, the comparator 24 generates a signal which sets the flip-flop 30. Being set in this manner, the flip-flop 30 generates an output signal which, when amplified, activates the solenoid valve 48, thereby allowing fluid communication between the vacuum station and the suction means at the appropriate station.

In the same manner as described above, when comparator 38 receives a signal from binary counter 40 which equals the selected end time signal from thumbwheel switch 36, the comparator 38 generates a signal which resets the flip-flop 30. Resetting the flip flop in this manner effectively turns off the solenoid valve 48 and precludes fluid communication between the vacuum station and the suction means.

From the foregoing it should be evident that the circuitry described above is suitable for implementing an embodiment for each station of the inserter machine. Accordingly, in one embodiment of the machine there are two switches such as thumbwheel switches 22 and 36 for each station of the machine. Since, in this embodiment, each station will have two switches, the switches may be remotely positioned on a console for selective adjustment by an operator. This flexibility enables an operator to easily vary the vacuum timings for the respectively differing stations rather than requiring a mechanic to internally adjust the valves or any circuitry associated therewith.

While the invention has been particularly shown and described with reference to preferred embodiments thereof, it will understood that those skilled in the art that various alternations in form and detail may be made therein without departing from the spirit and scope of the invention. For example, in some embodiments the limit switches 28 and 32 may perform virtually the same function and may be consolidated. Further, suitable switches of a different type other than thumbwheel switches 22 and 36 may be employed.

I claim:

1. A method for inserting material into an envelope using an inserting machine, said envelope having a front panel, a back panel, and a flap connected to said front panel to overlap said back panel, the method including the steps of:

transporting the envelope towards an inserting station of said machine on a transport means of said machine;

deflecting at least portions of selected pieces of insertion material from stacks of insertion material respectively contained at a plurality of insertion supply stations proximate said transport means, said deflection being accomplished by applying to said selected pieces for a period of time a vacuum, said vacuum being applied through a suction means situated at each insertion supply station of said machine;

extracting said selected pieces from each insertion supply station and depositing said selected pieces on said transport means;

inserting said selected pieces into said envelope at said inserting station; and, selectively adjusting for each individual insertion supply station the period of time for the application of said vacuum through said suction means.

2. The method of claim 1 wherein said machine has a cycle of operation divided into increments, and wherein said selective adjustment step further comprises the steps of:

selecting for each of said individual stations a start time to initiate application of said vacuum, said start time corresponding to an increment of the operation cycle of said machine; and, selecting for each of said individual stations an end time to cease application of said vacuum, said end time corresponding to an increment of the operating cycle of said machine.

3. The method of claim 1 further including the steps of:

deflecting at least a portion of said envelope from a stack of envelopes contained at an envelope supply station proximate said transport means, said deflection being accomplished by applying a vacuum to said envelope, said vacuum being applied through a suction means situated at the envelope supply station of said machine;

extracting said envelope from said envelope supply station and depositing said envelope on said transport means; and, selectively adjusting the period of time for the application of said vacuum through said suction means situated at said envelope supply station.

4. The method of claim 3 wherein said machine has a cycle of operation divided into increments, and wherein the improvement further comprises the steps of:

selecting a start time to initiate application of said vacuum at said envelope supply station, said start time corresponding to an increment of the operating cycle of said machine; and, selecting an end time to cease application of said vacuum at said envelope supply station, said end time corresponding to an increment of an operation cycle of said machine.

5. The method of claim 1 wherein said inserting step further includes the steps of:

positioning said envelope at said inserting station;

separating said front panel of said envelope from said back panel of said envelope, said separation being accomplished by applying to said front panel for a period of time a vacuum, said vacuum being applied through suction means situated below the plane of said transport means at said inserting station, and by applying to said back panel for a period of time a vacuum, said vacuum being applied through suction means situated above the plane of said transport means at said inserting station;

selectively adjusting the period of time for the application of said vacuum through said suction means situated below the plane of said transport means at said inserting station; and, selectively adjusting the period of time for the application of said vacuum through said suction means situated above the plane of said transport means at said inserting station.

6. The method of claim 5 wherein said machine has a cycle of operation divided into increments, and wherein the improvement further comprises the steps of:

selecting a start time to initiate application of said vacuum to said suction means below said transport means at said inserting station and to said suction means above said transport means at said inserting station, said start time corresponding to an increment of the operation cycle of said machine; and, selecting an end time to cease application of said vacuum to said suction means below said transport means at said inserting station and to said suction means above said transport means at said inserting station, said end time corresponding to an increment of the operation cycle of said machine.

7. The method of claim 5 wherein said inserting step further includes the step of:

opening the flap of said envelope, said opening being accomplished by applying to said flap a vacuum, said vacuum being applied through a flap-opening suction means situated at said inserting station; and, selectively adjusting the period of time for the application of said vacuum through said flap-opening suction means situated at said inserting station.

8. The method of claim 7 wherein said machine has a cycle of operation divided into increments, and wherein the improvement further comprises the steps of:

selecting a start time to initiate application of said vacuum to said flap-opening suction means, said start time corresponding to an increment of the operation cycle of said machine; and, selecting an end time to cease application of said vacuum to said flap-opening suction means, said end time corresponding to an increment of the operation cycle of said machine.

9. The method of claim 1 wherein said inserting step further includes the steps of:

opening the flap of said envelope, said opening being accomplished by applying to said flap a vacuum, said vacuum being applied through a flap-opening suction means situated at said inserting station; and, selectively adjusting the period of time for the application of said vacuum through said flap-opening suction means situated at said inserting station.

10. The method of claim 9 wherein said machine has a cycle of operation divided into increments, and wherein the improvement further comprises the steps of:

selecting a start time to initiate application of said vacuum to said flap-opening suction means, said start time corresponding to an increment of the operation cycle of said machine; and, selecting an end time to cease application of said vacuum to said flap-opening suction means, said end time corresponding to an increment of the operation cycle of said machine.

* * * * *